6/2/87 XR- 4,669,193

United States Patent [19]

Moore

[11] Patent Number: 4,669,193

[45] Date of Patent: Jun. 2, 1987

[54] HANDGUN SIGHT ALIGNMENT TOOL AND METHOD OF USING SAME

[76] Inventor: Harry E. Moore, 5436 Spruce St., Philadelphia, Pa. 19139

[21] Appl. No.: 901,293

[22] Filed: Aug. 28, 1986

[51] Int. Cl.[4] ..... G01B 3/30

[52] U.S. Cl. ..... 33/613; 33/233

[58] Field of Search ..... 33/233, 234, 242, 244, 33/252, 286, 180 R, 181 R

[56] References Cited

U.S. PATENT DOCUMENTS

| | | | |
|---|---|---|---|
| 1,679,221 | 7/1928 | Kelm | 33/252 |
| 2,484,368 | 10/1949 | Young | 33/252 |
| 2,593,870 | 4/1952 | Ganzhorn | 33/252 |
| 2,927,375 | 3/1960 | Luebreman | 33/233 |
| 3,984,917 | 10/1976 | Korzenienski | 33/244 |
| 4,000,574 | 1/1977 | Grant | 33/233 |

*Primary Examiner*—Harry N. Haroian
*Attorney, Agent, or Firm*—Richard C. Litman

[57] ABSTRACT

A tool and the methods of using the tool are disclosed which permits a handgunner to rapidly align the front and rear sights of a handgun in elevation and windage without employing other sighting devices or requiring the firing of any shots from the handgun to insure proper alignment of the front sight blade and the rear sight notch. The tool is temporarily installed on the gun with a slot in the tool engaging the front sight or front sight base and an alignment blade and stem extending to the adjustable rear sight. The rear sight is then adjusted to align the notch in the rear sight with the alignment stem and the tool is then removed with the sights now in correct alignment.

2 Claims, 7 Drawing Figures

HANDGUN SIGHT ALIGNMENT TOOL AND METHOD OF USING SAME

RELATED APPLICATION DATA

This application is a substitute for my application Ser. No. 552,396 filed Nov. 16, 1983 and now abandoned. It also discloses and claims in part, subject matter disclosed in my earlier filed application Ser. No. 496,076, filed May 19, 1983, now abandoned.

BACKGROUND OF THE INVENTION

This invention relates to a tool and method for obtaining a correct vertical and horizontal alignment of the front and rear sights of a handgun such as a target pistol or other hand weapon with adjustable sights.

Typically the sights employed on target pistols and revolvers comprise a fixed front sight having a blade extended from the front sight base attached to the barrel of the gun and an adjustable rear sight having a notch at the rear of the gun. The rear sight is adjustable vertically and horizontally, usually by means of a screw adjustment. The sights are designed so that when the front sight blade is centered in the notched rear sight and the shooter's eye is aligned with that sight picture, the shooter will then observe the point of impact on a target some distance away. The very short sight radius, i.e., the distance between front and rear sights on a handgun makes the proper alignment of the sights more critical than it might be on a rifle having an extended sight radius. This short sight radius means than a misalignment of the sights, which represents fractions of a minute of arc, will result in a significant impact error when a shot is fired at a target which is some distance away. According to the provisions of this invention there is provided a very simple tool for easy temporary installation on the front sight of the gun which permits the shooter to quickly adjust the rear sight in elevation and windage for proper alignment with the front sight blade using only a screwdriver or adjustment tool and requiring no additional external equipment or accessories. The present invention also discloses a tool and method of use which permits the shooter to accurately align the sights of a handgun without having to fire the weapon to insure that proper alignment of the sights has been achieved.

DESCRIPTION OF THE PREFERRED EMBODIMENTS

Figure 1:
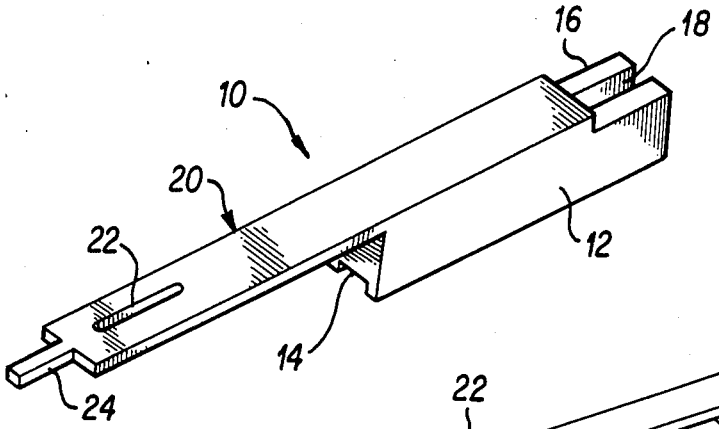
FIG. 1 is a perspective view of the sight alignment tool.

Referring now to the drawings wherein like numbers are used to describe like parts throughout, there is shown in FIG. 1 the sight alignment tool 10. The tool has a base 12 having a recess 14 therein for engagement with the rib or ventilated rib of a handgun. Extending from the front of the base 12 is a relieved section 16 having a rectangular slot 18 for tight engagement with the sides and rear of the front sight mounting base. Extending from the rear of the base 12 is a blade section 20, having an extended, centered slot 22 therein and having a centered protruding alignment stem 24 whose lower surface is at the precise height of the front sight blade at the end for alignment with the rear sight of the gun. The relieved section 16 permits observation of the front sight blade during alignment to insure that the blade is vertically aligned with the tool. The recess 14 which engages the rib of the gun further assures that the tool will be properly aligned along the barrel of the gun during the alignment procedure.

Figure 2:
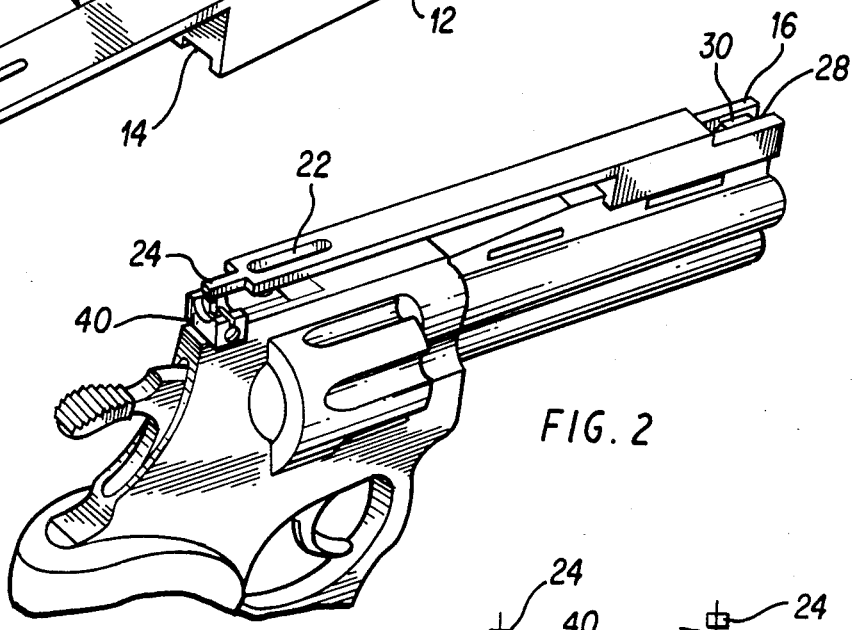
FIG. 2 is a perspective view of the sight alignment tool installed on a handgun preparatory to the alignment step.

In use the tool is installed on the gun having an adjustable rear sight 40 as shown in FIG. 2 with the slot 18 engaging the rear and sides of the front sight base 28 and the front sight blade 30 extending to the relieved section 16 in proper vertical alignment with the tool. This tool is not adjustable and must be made in individual sizes to fit specific handguns having various widths of front sight bases, heights of front sights, and different barrel lengths.

Figure 3A:
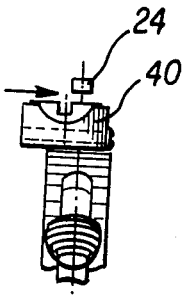
FIG. 3(*a*) is a rear view showing the sights horizontally mis-aligned and FIG. 3(*b*) shows the sight in correct horizontal alignment.
Figure 3B:
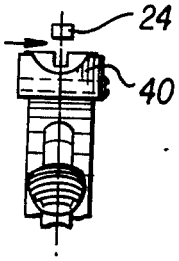
Figure 4A:
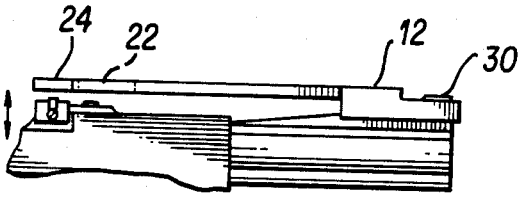
FIG. 4(*a*) shows the sight in vertical mis-alignment and FIG. 4(*b*) shows the sights in correct vertical alignment.
Figure 4B:
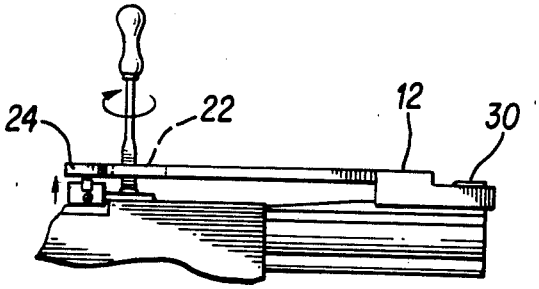
Figure 5:
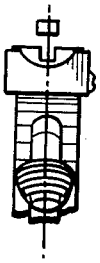
FIG. 5 shows the rear sight and the tool in correct vertical and horizontal alignment ready for removal of the tool.

With the tool placed on the gun as shown in FIG. 2 the notch in the rear sight 40 is aligned with the stem 24 horizontally by adjusting the sight adjustment screw in the base of the rear sight as shown in FIG. 3 and vertically by adjusting the rear sight adjusting screw by inserting a tool through the elongated slot 22 of the tool as shown in FIG. 4. With the rear sight notch properly aligned with the alignment stem 22 in both the horizontal and vertical directions the sight notch is then correctly aligned with the front sight blade 30. The tool is then removed from the gun and the gun is ready for use with its front and rear sights in correct alignment as shown in FIG. 5.

What is claimed is:

1. A tool for aligning the front and rear sights of a handgun comprising: a sight alignment tool base having a longitudinal centered recess in the bottom thereof for engagement with the rib of a handgun, a relieved section extending from the front of said base, said relieved portion having a slot therein for engagement with the sides and rear of the front sight mounting base, a blade section extending to the rear from the top of the tool base, said blade section having a centered longitudnal slot therein for passage of adjusting tools therethrough and a centered alignment stem portion extending from the blade for alignment with the notch in the rear sight of the handgun, said alignment stem having its lower surface at the height of the front sight blade.

2. A method of aligning the front and rear sights of a handgun, using a tool comprised of a tool base having a full section and a stepped lower section, said stepped section having a centered longitudinal slot therein, a blade extending from the upper surface of the opposite end of the base, said blade having a centered longitudnal slot therein and having a centered alignment stem extending from the end of said blade, comprising the steps of: placing the base of the tool on the barrel of the handgun with the recess in said base engaging the rib of the barrel and the slot in the stepped section engaging the front sight blade on the sides and rear of the blade, the blade and alignment stem extending to the rear of the handgun adjacent the rear sight; and adjusting the rear sight laterally and horizontally according to the alignment of the stem extending from the blade.

* * * * *